US010011780B2

(12) United States Patent
Podsiadlo et al.

(10) Patent No.: US 10,011,780 B2
(45) Date of Patent: Jul. 3, 2018

(54) METHODS OF REDUCING IMPURITIES IN DIESEL FUEL

(71) Applicant: ExxonMobil Research and Engineering Company, Annandale, NJ (US)

(72) Inventors: Paul Podsiadlo, Easton, PA (US); Lei Zhang, Basking Ridge, NJ (US); Kiara M. Benitez, Belvidere, NJ (US); Himanshu Gupta, Labanon, NJ (US); Darryl D. Lacy, Easton, PA (US); Scott J. Weigel, Allentown, PA (US); Xiaochun Xu, Spring, TX (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 15/582,825

(22) Filed: May 1, 2017

(65) Prior Publication Data

US 2017/0355912 A1 Dec. 14, 2017

Related U.S. Application Data

(60) Provisional application No. 62/347,807, filed on Jun. 9, 2016.

(51) Int. Cl.
*C10G 25/00* (2006.01)

(52) U.S. Cl.
CPC ..... *C10G 25/003* (2013.01); *C10G 2300/202* (2013.01); *C10G 2400/04* (2013.01)

(58) Field of Classification Search
None
See application file for complete search history.

(56) References Cited

U.S. PATENT DOCUMENTS

| | | | | |
|---|---|---|---|---|
| 5,057,296 | A | 10/1991 | Beck | |
| 6,569,312 | B1 | 5/2003 | Carroll et al. | |
| 2008/0105595 | A1* | 5/2008 | Koseoglu | C10G 25/00 208/91 |
| 2010/0155302 | A1* | 6/2010 | Kaminsky et al. | C10G 25/003 208/212 |

FOREIGN PATENT DOCUMENTS

| | | | |
|---|---|---|---|
| CN | 105368482 | * | 3/2016 |
| CN | 105368482 | * | 7/2017 |

OTHER PUBLICATIONS

Kresge et al., "Ordered mesoporous molecular sieves synthesized by a liquid-crystal template mechanism", Nature, Oct. 22, 1992, pp. 710-712, vol. 359, Nature Publishing Group.

Beck et al., "A New Family of Mesoporous Molecular Sieves Prepared with Liquid Crystal Templates", Journal of the American Chemical Society, Jun. 30, 1992, pp. 10834-10843, vol. 114, ACS Publications.

* cited by examiner

*Primary Examiner* — Tam M Nguyen

(57) ABSTRACT

Methods for reducing impurities and improving color in liquid hydrocarbon products (e.g., diesel fuel) are provided herein.

27 Claims, 2 Drawing Sheets

METHODS OF REDUCING IMPURITIES IN DIESEL FUEL

CROSS-REFERENCE TO RELATED APPLICATIONS

This application claims the benefit of U.S. Provisional Application No. 62/347,807, filed on Jun. 9, 2016, the entire contents of which are incorporated herein by reference.

FIELD

The present invention relates to methods for reducing impurities and improving color level in a liquid hydrocarbon product (e.g., diesel fuel).

BACKGROUND

Color is one of the specifications for final liquid hydrocarbon products, such as diesel fuels, wherein lighter color is required to meet specifications. In particular, desired color level of diesel fuel after processing is less than about 2.5 as measured according ASTM D6045. Even so, oil refineries typically target a manufacturing specification at or below a color specification of 2.0. Without being bound by theory, it is believed that discoloration of diesel fuel with less than about 10 ppm of sulfur following hydrotreating may originate from aromatic compounds, in particular multi-ring aromatic compounds. For example, toward the end of a hydrotreating catalyst cycle, decreasing hydrogenation effectiveness and increasing run temperatures of the catalyst may lead to an increased presence of multi-ring aromatic compounds thereby rendering the diesel fuel off-specification (off-spec) for color.

Methods to prevent such discoloration can include decreasing hydrotreating run times and/or increasing catalyst regeneration frequency, but such methods result in hydrotreating processes with lower efficiency and are not desirable. Thus, new methods for purifying diesel fuel and improving color of diesel fuel are needed, especially diesel fuel following hydrotreating.

SUMMARY

It has been found that activated carbon can be used to reduce impurities in a liquid hydrocarbon product (e.g., diesel fuel) and can improve color level in a liquid hydrocarbon product (e.g., diesel fuel).

Thus, in one aspect, embodiments of the invention provide a method for reducing impurities in a diesel fuel comprising contacting the diesel fuel with activated carbon, wherein the diesel fuel has a change in color level of greater than 2.7, wherein the change in color level is measured as a difference between the diesel fuel color level prior to contact with the activated carbon and the diesel fuel color level after contact with the activated carbon, and wherein the color level is measured according to D6045 ASTM.

In still another aspect, embodiments of the invention provide a method for improving color in a diesel fuel product comprising contacting the diesel fuel product with activated carbon resulting in an improved color diesel fuel product, which has undergone a change in color level of greater than 2.7, wherein the change in color level is measured as a difference between the diesel fuel product color level prior to contact with the activated carbon and the improved diesel fuel color product level after contact with the activated carbon, and wherein the color level is measured according to D6045 ASTM.

Other embodiments, including particular aspects of the embodiments summarized above, will be evident from the detailed description that follows.

DETAILED DESCRIPTION

Figure 1:
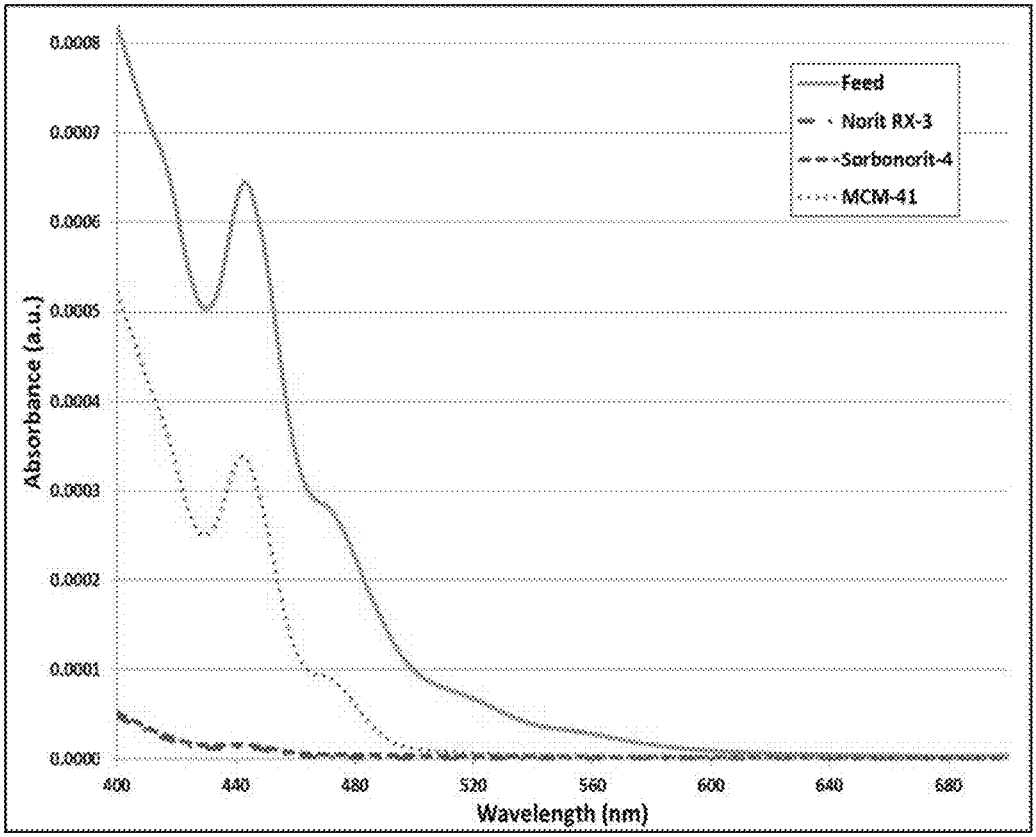
FIG. 1 illustrates a UV-Vis adsorption spectrum comparing neat diesel feed, diesel feed treated with Norit® RX-3, diesel feed treated with Sorbonorit®-4 and diesel feed treated with MCM-41.

In various aspects of the invention, methods for reducing impurities and improving color in a liquid hydrocarbon product (e.g., diesel fuel) are provided.

I. Definitions

For purposes of this invention and the claims hereto, the numbering scheme for the Periodic Table Groups is according to the IUPAC Periodic Table of Elements.

The term "and/or" as used in a phrase such as "A and/or B" herein is intended to include "A and B", "A or B", "A", and "B".

The terms "substituent", "radical", "group", and "moiety" may be used interchangeably.

As used herein, and unless otherwise specified, the term "percent" or "%" or "wt %" means part per hundred by weight. When the term "percent" or "%" is used to refer to a dimensionless ratio (i.e., a ratio of two values that are expressed in identical units), it should be understood that such a ratio truly means parts per hundred and need not be cited as "wt %", even if the two identical units of the values ratioed are "wt %".

As used herein, and unless otherwise specified, the term "$C_n$" means hydrocarbon(s) having n carbon atom(s) per molecule, wherein n is a positive integer.

As used herein, and unless otherwise specified, the term "hydrocarbon" means a class of compounds containing hydrogen bound to carbon, and encompasses (i) saturated hydrocarbon compounds, (ii) unsaturated hydrocarbon compounds, and (iii) mixtures of hydrocarbon compounds (saturated and/or unsaturated), including mixtures of hydrocarbon compounds having different values of n.

As used herein, the term "alkane" refers to non-aromatic saturated hydrocarbons with the general formula $C_nH_{(2n+2)}$, where n is 1 or greater. An alkane may be straight chained or branched. Examples of alkanes include, but are not limited to methane, ethane, propane, butane, pentane, hexane, heptane and octane. "Alkane" is intended to embrace all structural isomeric forms of an alkane. For example, butane encompasses n-butane and isobutane; pentane encompasses n-pentane, isopentane and neopentane.

As used herein, and unless otherwise specified, the term "aromatic" refers to unsaturated cyclic hydrocarbons having a delocalized conjugated π system and having from 5 to 24 carbon atoms (aromatic $C_5$-$C_{24}$ hydrocarbon), particularly from 5 to 22 carbon atoms (aromatic $C_5$-$C_{22}$ hydrocarbon) or from 5 to 20 carbon atoms (aromatic $C_5$-$C_{20}$ hydrocarbon). Exemplary aromatics include, but are not limited to benzene, toluene, xylenes, mesitylene, ethylbenzenes, cumene, naphthalene, methylnaphthalene, dimethylnaphthalenes, ethylnaphthalenes, acenaphthalene, anthracene, phenanthrene, tetraphene, naphthacene, benzanthracenes, fluoranthrene, pyrene, chrysene, triphenylene, and the like, and combinations thereof. Additionally, the aromatic may comprise one or more heteroatoms. Examples of heteroatoms include, but are not limited to, nitrogen, oxygen, and/or sulfur. Aromatics with one or more heteroatom include, but are not limited to furan, benzofuran, thiophene, benzothiophene, oxazole, thiazole and the like, and combinations thereof. The aromatic may comprise monocyclic (single ring), bicyclic (double ring), and/or polycyclic rings (multi-ring) (in some embodiments, at least monocyclic rings, only monocyclic and bicyclic rings, only polycyclic rings or only monocyclic rings) and may be fused rings.

As used herein, and unless otherwise specified, the term "paraffin," alternatively referred to as "alkane," refers to a saturated hydrocarbon chain of 1 to about 30 carbon atoms in length, such as, but not limited to methane, ethane, propane and butane. The paraffin may be straight-chain, cyclic or branched-chain. "Paraffin" is intended to embrace all structural isomeric forms of paraffins. The term "non-cyclic paraffin" refers to straight-chain or branched-chain paraffins. The term "isoparaffin" refer to branched-chain paraffin, and the term "n-paraffin" or "normal paraffin" refers to straight-chain paraffins.

As used herein, and unless otherwise specified, the term "naphthene" refers to a cycloalkane (also known as a cycloparaffin) having from 3-30 carbon atoms. Examples of naphthenes include, but are not limited to cyclopropane, cyclobutane, cyclopentane, cyclohexane, cycloheptane, cyclooctane and the like. The term naphthene encompasses single-ring naphthenes and multi-ring naphthenes. The multi-ring naphthenes may have two or more rings, e.g., two-rings, three-rings, four-rings, five-rings, six-rings, seven-rings, eight-rings, nine-rings, and ten-rings. The rings may be fused and/or bridged. The naphthene can also include various side chains, particularly one or more alkyl side chains of 1-10 carbons.

As used herein, and unless otherwise specified, the term "diesel fuel" or "diesel fuel product" refers to a hydrocarbon product having a boiling point range falling within about 110° C. (initial number represents IBP, or alternatively T1 or T2) to about 425° C. (final number represents FBP, or alternatively T99 or T98), e.g., about 110° C. to about 400° C., about 110° C. to about 385° C., about 110° C. to about 360° C., about 120° C. to about 425° C., about 120° C. to about 400° C., about 120° C. to about 385° C., about 120° C. to about 360° C., about 140° C. to about 425° C., about 140° C. to about 400° C., about 140° C. to about 385° C., or about 140° C. to about 360° C., as measured by ASTM D2887 (Simulated Distillation, or SIMDIS). IBP and FBP represent initial boiling point and final boiling point, respectively. Txx represents the temperature at which about xx % of the hydrocarbon product boils—for instance, T2 is the point at which about 2% of the hydrocarbon product boils. In particular, the T2-T98 boiling range can fall within about 110° C. to about 425° C., about 110° C. to about 400° C., or about 120° C. to about 385° C. Diesel boiling-range fuel may be used in any suitable engine or process which requires or can utilize the above-mentioned boiling point range, e.g., as transportation fuel, turbine fuel, bunker fuel, and/or heating fuel.

As used herein, and unless otherwise specified, the term "adsorption" includes physisorption, chemisorption, and condensation onto a solid material and combinations thereof.

As used herein, and unless otherwise specified, the term "ppm" means parts per million by weight.

II. Methods for Reducing Impurities and/or Improving Color

In various aspects, methods for reducing impurities in a liquid hydrocarbon product, such as diesel fuel, are provided. Preferably in such aspects, or optionally separately, methods for improving color in a liquid hydrocarbon product, such as diesel fuel, are provided. The methods can comprise contacting a liquid hydrocarbon product with activated carbon.

As used herein, the term "activated carbon" or "active carbon" refers to a form of carbon by which the pore structure is enhanced through any suitable process, e.g., an activation process. Typical activation processes include treatment of carbon sources either thermally (e.g., with an oxidizing gas or steam, inert gases such as nitrogen, helium, or argon, to control the pore size and surface area of the material) or chemically (e.g., with acid, such as phosphoric acid, metal salts, or oxidized to change surface functionality after the formation of the carbon species). Examples of such carbon sources can include, but are not limited to, resin wastes, coal, coal coke, petroleum coke, lignites, polymeric materials, and lignocellulosic materials including pulp and paper, residues from pulp production, wood (e.g., wood chips, sawdust, and wood flour), nut shell (e.g., almond shell and coconut shell), kernel, and fruit pits (like olive and cherry stones), as well as combinations thereof. Examples of suitable commercial activated carbons can include, but are not limited to Norit® and Sorbonorit® activated carbons (e.g., Norit® RX-3, Sorbonorit® 4), Calgon activated carbons, (e.g., Centaur®, MRX 10×30, SolCarb, Filtrasorb®, CAL series, WPX series, OVC series, AP series, WS series), CARBOCHEM® carbons (e.g., PS-40, CA-50, DC-40), Oxbow carbons (e.g., OxPure® series), and mixtures/combinations thereof. The active carbon may optionally comprise other materials such as zeolites, transition metal oxides, aluminum oxide, silica, or clays.

In various aspects, the activated carbon may have a surface area as measured using nitrogen adsorption-desorption isotherm techniques within the expertise of one skilled in the art, such as the BET (Brunauer Emmet Teller) method, of at least about 500 $m^2/g$, e.g., at least about 600 $m^2/g$, at least about 700 $m^2/g$, at least about 800 $m^2/g$, at least about 900 $m^2/g$, at least about 1000 $m^2/g$, at least about 1100 $m^2/g$, at least about 1200 $m^2/g$, at least about 1300 $m^2/g$, at least about 1400 $m^2/g$, at least about 1500 $m^2/g$, at least about 1600 $m^2/g$, at least about 1700 $m^2/g$, at least about 1800 $m^2/g$, or at least about 1900 $m^2/g$. In particular, the activated carbon may have a surface area of at least about 1000 $m^2/g$, at least about 1100 $m^2/g$, or at least about 1200 $m^2/g$.

Additionally or alternatively, the activated carbon may have a surface area of at most about 2000 $m^2/g$, e.g., at most about 1900 $m^2/g$, at most about 1800 $m^2/g$, at most about 1700 $m^2/g$, at most about 1600 $m^2/g$, at most about 1500 $m^2/g$, at most about 1400 $m^2/g$, at most about 1300 $m^2/g$, at most about 1200 $m^2/g$, at most about 1100 $m^2/g$, at most about 1000 $m^2/g$, at most about 900 $m^2/g$, at most about 800 $m^2/g$, at most about 700 $m^2/g$, or at most about 600 $m^2/g$.

Additionally or alternatively, the activated carbon may have a surface area from about 500 $m^2/g$ to about 2000 $m^2/g$, e.g., about 500 $m^2/g$ to about 1900 $m^2/g$, about 500 $m^2/g$ to about 1800 $m^2/g$, about 500 $m^2/g$ to about 1700 $m^2/g$, about 500 $m^2/g$ to about 1600 $m^2/g$, about 500 $m^2/g$ to about 1500 $m^2/g$, about 500 $m^2/g$ to about 1400 $m^2/g$, about 500 $m^2/g$ to about 1300 $m^2/g$, about 500 $m^2/g$ to about 1200 $m^2/g$, about 500 $m^2/g$ to about 1100 $m^2/g$, about 500 $m^2/g$ to about 1000 $m^2/g$, about 500 $m^2/g$ to about 900 $m^2/g$, about 500 $m^2/g$ to about 800 $m^2/g$, about 600 $m^2/g$ to about 2000 $m^2/g$, about 600 $m^2/g$ to about 1900 $m^2/g$, about 600 $m^2/g$ to about 1800 $m^2/g$, about 600 $m^2/g$ to about 1700 $m^2/g$, about 600 $m^2/g$ to about 1600 $m^2/g$, about 600 $m^2/g$ to about 1500 $m^2/g$, about 600 $m^2/g$ to about 1400 $m^2/g$, about 600 $m^2/g$ to about 1300 $m^2/g$, about 600 $m^2/g$ to about 1200 $m^2/g$, about 600 $m^2/g$ to about 1100 $m^2/g$, about 600 $m^2/g$ to about 1000 $m^2/g$, about 600 $m^2/g$ to about 900 $m^2/g$, about 700 $m^2/g$ to about 2000 $m^2/g$, about 700 $m^2/g$ to about 1900 $m^2/g$, about 700 $m^2/g$ to about 1800 $m^2/g$, about 700 $m^2/g$ to about 1700 $m^2/g$, about 700 $m^2/g$ to about 1600 $m^2/g$, about 700 $m^2/g$ to about 1500 $m^2/g$, about 700 $m^2/g$ to about 1400 $m^2/g$, about 700 $m^2/g$ to about 1300 $m^2/g$, about 700 $m^2/g$ to about 1200 $m^2/g$, about 700 $m^2/g$ to about 1100 $m^2/g$, about 700 $m^2/g$ to about 1000 $m^2/g$, about 800 $m^2/g$ to about 2000 $m^2/g$, about 800 $m^2/g$ to about 1900 $m^2/g$, about 800 $m^2/g$ to about 1800 $m^2/g$, about 800 $m^2/g$ to about 1700 $m^2/g$, about 800 $m^2/g$ to about 1600 $m^2/g$, about 800 $m^2/g$ to about 1500 $m^2/g$, about 800 $m^2/g$ to about 1400 $m^2/g$, about 800 $m^2/g$ to about 1300 $m^2/g$, about 800 $m^2/g$ to about 1200 $m^2/g$, about 800 $m^2/g$ to about 1100 $m^2/g$, about 800 $m^2/g$ to about 1000 $m^2/g$, about 900 $m^2/g$ to about 2000 $m^2/g$, about 900 $m^2/g$ to about 1900 $m^2/g$, about 900 $m^2/g$ to about 1800 $m^2/g$, about 900 $m^2/g$ to about 1700 $m^2/g$, about 900 $m^2/g$ to about 1600 $m^2/g$, about 900 $m^2/g$ to about 1500 $m^2/g$, about 900 $m^2/g$ to about 1400 $m^2/g$, about 900 $m^2/g$ to about 1300 $m^2/g$, about 900 $m^2/g$ to about 1200 $m^2/g$, about 900 $m^2/g$ to about 1100 $m^2/g$, about 900 $m^2/g$ to about 1000 $m^2/g$, about 1000 $m^2/g$ to about 2000 $m^2/g$, about 1000 $m^2/g$ to about 1900 $m^2/g$, about 1000 $m^2/g$ to about 1800 $m^2/g$, about 1000 $m^2/g$ to about 1700 $m^2/g$, about 1000 $m^2/g$ to about 1600 $m^2/g$, about 1000 $m^2/g$ to about 1500 $m^2/g$, about 1000 $m^2/g$ to about 1400 $m^2/g$, about 1000 $m^2/g$ to about 1300 $m^2/g$, about 1000 $m^2/g$ to about 1200 $m^2/g$, about 1000 $m^2/g$ to about 1100 $m^2/g$, about 1100 $m^2/g$ to about 2000 $m^2/g$, about 1100 $m^2/g$ to about 1900 $m^2/g$, about 1100 $m^2/g$ to about 1800 $m^2/g$, about 1100 $m^2/g$ to about 1700 $m^2/g$, about 1100 $m^2/g$ to about 1600 $m^2/g$, about 1100 $m^2/g$ to about 1500 $m^2/g$, about 1100 $m^2/g$ to about 1400 $m^2/g$, about 1100 $m^2/g$ to about 1300 $m^2/g$, about 1100 $m^2/g$ to about 1200 $m^2/g$, about 1200 $m^2/g$ to about 2000 $m^2/g$, about 1200 $m^2/g$ to about 1900 $m^2/g$, about 1200 $m^2/g$ to about 1800 $m^2/g$, about 1200 $m^2/g$ to about 1700 $m^2/g$, about 1200 $m^2/g$ to about 1600 $m^2/g$, about 1200 $m^2/g$ to about 1500 $m^2/g$, about 1200 $m^2/g$ to about 1400 $m^2/g$, about 1200 $m^2/g$ to about 1300 $m^2/g$, about 1300 $m^2/g$ to about 2000 $m^2/g$, about 1300 $m^2/g$ to about 1900 $m^2/g$, about 1300 $m^2/g$ to about 1800 $m^2/g$, about 1300 $m^2/g$ to about 1700 $m^2/g$, about 1300 $m^2/g$ to about 1600 $m^2/g$, about 1300 $m^2/g$ to about 1500 $m^2/g$, about 1300 $m^2/g$ to about 1400 $m^2/g$, about 1400 $m^2/g$ to about 2000 $m^2/g$, about 1400 $m^2/g$ to about 1900 $m^2/g$, about 1400 $m^2/g$ to about 1800 $m^2/g$, about 1400 $m^2/g$ to about 1700 $m^2/g$, about 1400 $m^2/g$ to about 1600 $m^2/g$, or about 1400 $m^2/g$ to about 1500 $m^2/g$. In particular, the activated carbon may have a surface area of about 500 $m^2/g$ to about 2000 $m^2/g$, about 700 $m^2/g$ to about 2000 $m^2/g$, about 800 $m^2/g$ to about 1800 $m^2/g$, about 900 $m^2/g$ to about 1700 $m^2/g$, or about 1000 $m^2/g$ to about 1600 $m^2/g$. In particular, the activated carbon may have a surface area from about 500 $m^2/g$ to about 2000 $m^2/g$, from about 1000 $m^2/g$ to about 2000 $m^2/g$, from about 1200 $m^2/g$ to about 2000 $m^2/g$, or from about 1000 $m^2/g$ to about 1800 $m^2/g$.

Advantageously, the activated carbon may adsorb various impurities from the liquid hydrocarbon that may cause discoloration. The impurities described herein can be polar compounds and/or aromatic compounds. As used herein, "polar compound" refers to a compound that has portions of negative and/or positive charges forming negative and/or positive poles. While a polar compound does not carry a net electric charge, the electrons are unequally shared between the nuclei. Water is considered a polar compound in the present invention. Examples of polar compounds can include, but are not limited to, nitrogen-containing compounds (e.g., $N_2$, $NH_3$, $NO_2$, pyrrole, pyridine, quinoline, indazole, etc.) and/or sulfur-containing compounds (e.g., $SO_2$, $H_2S$, thiophene, benzothiophene, dibenzothiophene, etc.). Additionally or alternatively, the aromatic compounds can be single ring aromatics, double ring aromatics, multi-ring aromatics (e.g., 3 or more rings), and a combination thereof. Examples of single ring aromatic compounds can include, but are not limited to, benzene, toluene, furan, pyrrole, thiophene, pyridine, pyrazine, pyrimidine, and triazine, as well as combinations thereof. Examples of double ring aromatic compounds can include, but are not limited to, benzothiophene, purine, benzimidazole, indazole, naphthalene, quinoline, and quinoxaline, as well as combinations thereof. Examples of multi-ring aromatic compounds include, but are not limited to, anthracene, acridine, phenanthrene, tetracene, chrysene, triphenylene, pyrene, pentacene, coronene, and corannulene, as well as combinations thereof. In particular, at least some multi-ring aromatics and optionally also at least some double ring aromatics can be removed from the liquid hydrocarbon.

Additionally or alternatively, the activated carbon can have a selectivity for multi-ring aromatics compared to single ring aromatics of at least about 1.1, e.g., at least about 1.2, at least about 1.4, at least about 1.5, at least about 1.6, at least about 1.8, at least about 2.0, at least about 2.5, at least about 3.0, or at least about 4.0. Additionally or alternatively, the activated carbon can have a selectivity for multi-ring aromatics compared to single ring aromatics from about 1.1 to about 4.0, such as from about 1.1 to about 3.0, from about 1.2 to about 2.5, from about 1.1 to at least about 2.0, or from about 1.1 to about 1.8.

In various embodiments, the liquid hydrocarbon may comprise diesel fuel, jet fuel, kerosene, and/or gasoline. In particular, the liquid hydrocarbon may comprise or be diesel fuel. With regard to diesel fuel, color is one of the specifications for the final product. Color level of the liquid hydrocarbon product (e.g., diesel fuel) may be measured according to D6045 ASTM. It has been discovered, that activated carbon described herein may selectively remove impurities described herein from a liquid hydrocarbon product (e.g., diesel fuel) and thereby may improve color level of the liquid hydrocarbon product (e.g., diesel fuel).

Thus, in various aspects, the liquid hydrocarbon product (e.g., diesel fuel) may have a change (reduction) in color level of at least about 1.5, such as at least about 2.0, at least about 2.5, at least about 2.7, at least about 3.0, at least about 3.5, at least about 4.0, at least about 4.5, or at least about 5.0. In particular, the liquid hydrocarbon product (e.g., diesel fuel) may have a change in color level of at least about 2.5, at least about 2.7, at least about 3.0, at least about 3.5 or at least about 4.0. As understood herein, the change in color level is measured as a difference between the liquid hydrocarbon product (e.g., diesel fuel) color level prior to contact with the activated carbon and the liquid hydrocarbon product (e.g., diesel fuel) color level after contact with the activated carbon, and wherein the color level is measured according to D6045 ASTM.

An "improved color liquid hydrocarbon product"/"improved color diesel fuel" or a "reduced impurity liquid hydrocarbon product"/"reduced impurity diesel fuel" refers to a liquid hydrocarbon product (e.g., diesel fuel) with a lower color level as measured according to D6045 ASTM following contact with the activated carbon as described herein. For example, if a liquid hydrocarbon product (e.g., diesel fuel) initially has a color level of 5.0 as measured according to D6045 ASTM prior to contact with the activated carbon, an improved liquid hydrocarbon product (e.g., diesel fuel) would have a color level of less than 5.0 as measured according to D6045 ASTM following contact with the activated carbon.

Additionally or alternatively, the liquid hydrocarbon product (e.g., diesel fuel) may have a change (reduction) in color level of about 1.5 to about 8.0, e.g., about 1.5 to about 5.0, about 1.5 to about 4.5, about 1.5 to about 4.0, about 1.5 to about 3.5, about 1.5 to about 3.0, about 1.5 to about 2.7, about 1.5 to about 2.5, about 1.5 to about 2.0, about 2.0 to about 8.0, about 2.0 to about 5.0, about 2.0 to about 4.5, about 2.0 to about 4.0, about 2.0 to about 3.5, about 2.0 to about 3.0, about 2.0 to about 2.7, about 2.0 to about 2.5, about 2.5 to about 8.0, about 2.5 to about 5.0, about 2.5 to about 4.5, about 2.5 to about 4.0, about 2.5 to about 3.5, about 2.5 to about 3.0, about 2.5 to about 2.7, about 2.7 to about 8.0, about 2.7 to about 5.0, about 2.7 to about 4.5, about 2.7 to about 4.0, about 2.7 to about 3.5, about 2.7 to about 3.0, about 3.0 to about 8.0, about 3.0 to about 5.0, about 3.0 to about 4.5, about 3.0 to about 4.0, about 3.0 to about 3.5, about 3.5 to about 8.0, about 3.5 to about 5.0, about 3.5 to about 4.5, about 3.5 to about 4.0, about 4.0 to about 8.0, about 4.0 to about 5.0, about 4.0 to about 4.5, about 4.5 to about 8.0, about 4.5 to about 5.0, or about 5.0 to about 8.0. In particular, the liquid hydrocarbon product (e.g., diesel fuel) may have a change in color level of about 2.7 to about 8.0, about 2.7 to about 5.0, about 3.0 to about 8.0, about 3.5 to about 8.0, or about 3.0 to about 5.0.

Additionally or alternatively, prior to contact with the activated carbon as described herein, the liquid hydrocarbon product (e.g., diesel fuel) may have a color level (as measured according to D6045 ASTM) of at least about 2.0, e.g., at least about 2.5, at least about 3.0, at least about 3.5, at least about 4.0, at least about 4.5, at least about 5.0, at least about 5.5, or at least about 6.0. In particular, prior to contact with the activated carbon as described herein, the liquid hydrocarbon product (e.g., diesel fuel) may have a color level (as measured according to D6045 ASTM) of at least about 3.0, at least about 3.5, or at least about 4.0.

Additionally or alternatively, prior to contact with the activated carbon as described herein, the liquid hydrocarbon product (e.g., diesel fuel) may have a color level (as measured according to D6045 ASTM) of about 2.0 to about 9.0, e.g., about 2.0 to about 7.0, about 2.0 to about 6.0, about 2.0 to about 5.5, about 2.0 to about 5.0, about 2.0 to about 4.5, about 2.0 to about 4.0, about 2.0 to about 3.5, about 2.0 to about 3.0, about 2.0 to about 2.5, about 2.5 to about 9.0, about 2.5 to about 7.0, about 2.5 to about 6.0, about 2.5 to about 5.5, about 2.5 to about 5.0, about 2.5 to about 4.5, about 2.5 to about 4.0, about 2.5 to about 3.5, about 2.5 to about 3.0, about 3.0 to about 9.0, about 3.0 to about 7.0, about 3.0 to about 6.0, about 3.0 to about 5.5, about 3.0 to about 5.0, about 3.0 to about 4.5, about 3.0 to about 4.0, about 3.0 to about 3.5, about 3.5 to about 9.0, about 3.5 to about 7.0, about 3.5 to about 6.0, about 3.5 to about 5.5, about 3.5 to about 5.0, about 3.5 to about 4.5, about 3.5 to about 4.0, about 4.0 to about 9.0, about 4.0 to about 7.0, about 4.0 to about 6.0, about 4.0 to about 5.5, about 4.0 to about 5.0, about 4.0 to about 4.5, about 4.5 to about 9.0, about 4.5 to about 7.0, about 4.5 to about 6.0, about 4.5 to about 5.5, about 4.5 to about 5.0, about 5.0 to about 9.0, about 5.0 to about 7.0, about 5.0 to about 6.0, about 5.0 to about 5.5, about 5.5 to about 9.0, about 5.5 to about 7.0, about 5.5 to about 6.0, about 6.0 to about 9.0, about 6.0 to about 7.0, or about 7.0 to about 9.0. In particular, prior to contact with the activated carbon as described herein, the liquid hydrocarbon product (e.g., diesel fuel) may have a color level (as measured according to D6045 ASTM) of about 3.0 to about 9.0, about 3.5 to about 7.0, or about 4.0 to about 6.0.

Additionally or alternatively, following contact with the activated carbon as described herein, the liquid hydrocarbon product (e.g., diesel fuel) may have a color level (as measured according to D6045 ASTM) of at most about 4.0, e.g., at most about 3.5, at most about 3.0, at most about 2.5, at most about 2.0, at most about 1.5, at most about 1.0, less than equal to about 0.50, or about 0.0. In particular, following contact with the activated carbon as described herein, the liquid hydrocarbon product (e.g., diesel fuel) may have a color level (as measured according to D6045 ASTM) of at most about 2.5, at most about 2.0, or at most about 1.0.

Additionally or alternatively, following contact with the activated carbon as described herein, the liquid hydrocarbon product (e.g., diesel fuel) may have a color level (as measured according to D6045 ASTM) of about 0.0 to about 4.0, e.g., about 0.0 to about 3.5, about 0.0 to about 3.0, about 0.0 to about 2.5, about 0.0 to about 2.0, about 0.0 to about 1.5, about 0.0 to about 1.0, about 0.0 to about 0.50, about 0.50 to about 4.0, about 0.50 to about 3.5, about 0.50 to about 3.0, about 0.50 to about 2.5, about 0.50 to about 2.0, about 0.50 to about 1.5, about 0.50 to about 1.0, about 1.0 to about 4.0, about 1.0 to about 3.5, about 1.0 to about 3.0, about 1.0 to about 2.5, about 1.0 to about 2.0, about 1.0 to about 1.5, about 1.5 to about 4.0, about 1.5 to about 3.5, about 1.5 to about 3.0, about 1.5 to about 2.5, about 1.5 to about 2.0, about 2.0 to about 4.0, about 2.0 to about 3.5, about 2.0 to about 3.0, or about 2.0 to about 2.5. In particular, the liquid hydrocarbon product (e.g., diesel fuel) may have a color level (as measured according to D6045 ASTM) of about 0.0 to about 2.5, about 0.0 to about 2.0, about 0.50 to about 2.5, about 0.50 to about 2.0, or about 0.0 to about 1.0.

In some cases, discoloration in the liquid hydrocarbon product (e.g., diesel fuel) may be due to aromatic compounds (e.g., multi-ring aromatic) and/or polar compounds present in the liquid hydrocarbon product comprising various sulfur levels. Thus, the liquid hydrocarbon product (e.g., diesel fuel) prior to contact with the activated carbon described herein may comprise at most about 50 ppm sulfur, e.g., at most about 45 ppm sulfur, at most about 40 ppm sulfur, at most about 35 ppm sulfur, at most about 30 ppm sulfur, at most about 25 ppm sulfur, at most about 20 ppm sulfur, at most about 18 ppm sulfur, at most about 15 ppm sulfur, at most about 10 ppm sulfur, at most about 8.0 ppm sulfur, at most about 5.0 ppm sulfur, at most about 3.0 ppm sulfur, at most about 2.0 ppm sulfur, at most about 1.0 ppm sulfur, at most about 0.50 ppm sulfur or at most about 0.10 ppm sulfur. Particularly, the liquid hydrocarbon product (e.g., diesel fuel) prior to contact with the activated carbon described herein may comprise at most about 20 ppm sulfur, at most about 15 ppm sulfur, at most about 10 ppm sulfur, or at most about 5.0 ppm sulfur.

Additionally or alternatively, the liquid hydrocarbon product (e.g., diesel fuel) prior to contact with the activated carbon described herein may comprise about 0.1 ppm to about 50 ppm sulfur, about 0.1 ppm to about 40 ppm sulfur, about 0.1 ppm to about 30 ppm sulfur, about 0.1 ppm to about 25 ppm sulfur, about 0.1 ppm to about 20 ppm sulfur, about 0.1 ppm to about 18 ppm sulfur, about 0.1 ppm to about 15 ppm sulfur, about 0.1 ppm to about 10 ppm sulfur, about 0.10 ppm to about 8.0 ppm sulfur, about 0.1 ppm to about 5.0 ppm sulfur, about 0.1 ppm to about 3.0 ppm sulfur, about 0.1 ppm to about 2.0 ppm sulfur, about 0.1 ppm to about 1.0 ppm sulfur, about 0.1 ppm to about 0.5 ppm sulfur, 0.5 ppm to about 50 ppm sulfur, about 0.5 ppm to about 40 ppm sulfur, about 0.5 ppm to about 30 ppm sulfur, about 0.5 ppm to about 25 ppm sulfur, about 0.5 ppm to about 20 ppm sulfur, about 0.5 ppm to about 18 ppm sulfur, about 0.5 ppm to about 15 ppm sulfur, about 0.5 ppm to about 10 ppm sulfur, about 0.5 ppm to about 8.0 ppm sulfur, about 0.5 ppm to about 5.0 ppm sulfur, about 0.5 ppm to about 3.0 ppm sulfur, about 0.5 ppm to about 2.0 ppm sulfur, about 0.5 ppm to about 1.0 ppm sulfur, about 1.0 ppm to about 40 ppm sulfur, about 1.0 ppm to about 40 ppm sulfur, about 1.0 ppm to about 30 ppm sulfur, about 1.0 ppm to about 25 ppm sulfur, about 1.0 ppm to about 20 ppm sulfur, about 1.0 ppm to about 18 ppm sulfur, about 1.0 ppm to about 15 ppm sulfur, about 1.0 ppm to about 10 ppm sulfur, about 1.0 ppm to about 8.0 ppm sulfur, about 1.0 ppm to about 5.0 ppm sulfur, about 1.0 ppm to about 3.0 ppm sulfur, about 1.0 ppm to about 2.0 ppm sulfur, about 2.0 ppm to about 40 ppm sulfur, about 2.0 ppm to about 40 ppm sulfur, about 2.0 ppm to about 30 ppm sulfur, about 2.0 ppm to about 25 ppm sulfur, about 2.0 ppm to about 20 ppm sulfur, about 2.0 ppm to about 18 ppm sulfur, about 2.0 ppm to about 15 ppm sulfur, about 2.0 ppm to about 10 ppm sulfur, about 2.0 ppm to about 8.0 ppm sulfur, about 2.0 ppm to about 5.0 ppm sulfur, about 2.0 ppm to about 4.0 ppm sulfur, about 2.0 ppm to about 3.0 ppm sulfur, about 5.0 ppm to about 40 ppm sulfur, about 5.0 ppm to about 40 ppm sulfur, about 5.0 ppm to about 30 ppm sulfur, about 5.0 ppm to about 25 ppm sulfur, about 5.0 ppm to about 20 ppm sulfur, about 5.0 ppm to about 18 ppm sulfur, about 5.0 ppm to about 15 ppm sulfur, about 5.0 ppm to about 10 ppm sulfur, about 5.0 ppm to about 8.0 ppm sulfur, or about 5.0 ppm to about 7.0 ppm sulfur. In particular, the liquid hydrocarbon product (e.g., diesel fuel) prior to contact with the activated carbon described herein may comprise about 0.1 ppm to about 50 ppm sulfur, about 0.1 ppm to about 20 ppm sulfur, about 0.5 ppm to about 15 ppm sulfur, or about 0.5 ppm to about 10 ppm.

In various embodiments, the liquid hydrocarbon product (e.g., diesel fuel) prior to contact with the activated carbon described herein may comprise at most about 20 ppm nitrogen, e.g., at most about 15 ppm nitrogen, at most about 10 ppm nitrogen, at most about 15 ppm nitrogen, at most about 10 ppm nitrogen, at most about 5.0 ppm nitrogen, at most about 1.0 ppm nitrogen, at most about 0.5 ppm nitrogen, at most about 0.1 ppm nitrogen, at most about 0.05 ppm nitrogen, or at most about 0.01 ppm nitrogen. In particular, the liquid hydrocarbon product (e.g., diesel fuel) prior to contact with the activated carbon described herein may comprise at most about 10 ppm nitrogen, at most about 5.0 ppm nitrogen, at most about 1.0 ppm nitrogen, at most about 0.1 ppm nitrogen, or at most about 0.05 ppm nitrogen.

Additionally or alternatively, the liquid hydrocarbon product (e.g., diesel fuel) prior to contact with the activated carbon described herein may comprise about 0.01 ppm to about 20 ppm nitrogen, e.g., about 0.01 ppm to about 15 ppm nitrogen, about 0.01 ppm to about 10 ppm nitrogen, about 0.01 ppm to about 5.0 ppm nitrogen, about 0.01 ppm to about 1.0 ppm nitrogen, about 0.01 ppm to about 0.05 ppm nitrogen, about 0.05 ppm to about 20 ppm nitrogen, about 0.05 ppm to about 15 ppm nitrogen, about 0.05 ppm to about 10 ppm nitrogen, about 0.05 ppm to about 5.0 ppm nitrogen, about 0.05 ppm to about 1.0 ppm nitrogen, about 1.0 ppm to about 20 ppm nitrogen, about 1.0 ppm to about 15 ppm nitrogen, about 1.0 ppm to about 10 ppm nitrogen, about 1.0 ppm to about 5.0 ppm nitrogen, about 5.0 ppm to about 20 ppm nitrogen, about 5.0 ppm to about 15 ppm nitrogen, about 5.0 ppm to about 10 ppm nitrogen, about 10 ppm to about 20 ppm nitrogen, about 10 ppm to about 15 ppm nitrogen or about 15 ppm to about 20 ppm nitrogen. In particular, the liquid hydrocarbon product (e.g., diesel fuel) prior to contact with the activated carbon described herein may comprise about 0.01 ppm to about 20 ppm nitrogen, about 0.05 ppm to about 10 ppm nitrogen, about 0.05 ppm to about 5.0 ppm nitrogen, or about 0.5 ppm to about 20 ppm nitrogen.

Additionally or alternatively, the liquid hydrocarbon product (e.g., diesel fuel) prior to contact with the activated carbon described herein may comprise at most about 20 wt % non-cyclic paraffins, e.g., at most about 15 wt % non-cyclic paraffins, at most about 10 wt % non-cyclic paraffins, at most about 7.0 wt % non-cyclic paraffins, at most about 5.0 wt % non-cyclic paraffins, or at most about 1.0 wt % non-cyclic paraffins. In particular, the liquid hydrocarbon product (e.g., diesel fuel) prior to contact with the activated carbon described herein may comprise at most about 15 wt % non-cyclic paraffins, at most about 10 wt % non-cyclic paraffins, or at most about 7.0 wt % non-cyclic paraffins, Additionally or alternatively, the liquid hydrocarbon product (e.g., diesel fuel) prior to contact with the activated carbon described herein may comprise about 1.0 wt % to about 20 wt % non-cyclic paraffins, e.g., about 1.0 wt % to about 15 wt % non-cyclic paraffins, about 1.0 wt % to about 10 wt % non-cyclic paraffins, about 1.0 wt % to about 7.0 wt % non-cyclic paraffins, about 1.0 wt % to about 5.0 wt % non-cyclic paraffins, about 5.0 wt % to about 20 wt % non-cyclic paraffins, about 5.0 wt % to about 15 wt % non-cyclic paraffins, about 5.0 wt % to about 10 wt % non-cyclic paraffins, about 5.0 wt % to about 7.0 wt % non-cyclic paraffins, about 7.0 wt % to about 20 wt % non-cyclic paraffins, about 7.0 wt % to about 15 wt % non-cyclic paraffins, about 7.0 wt % to about 10 wt % non-cyclic paraffins, about 10 wt % to about 20 wt % non-cyclic paraffins, about 10 wt % to about 15 wt % non-cyclic paraffins, or about 15 wt % to about 20 wt % non-cyclic paraffins. In particular, the liquid hydrocarbon product (e.g., diesel fuel) prior to contact with the activated carbon described herein may comprise about 1.0 wt % to about 20 wt % non-cyclic paraffins, about 1.0 wt % to about 15 wt % non-cyclic paraffins, or about 1.0 wt % to about 10 wt % non-cyclic paraffins.

Additionally or alternatively, the liquid hydrocarbon product (e.g., diesel fuel) prior to contact with the activated carbon described herein may comprise at most about 80 wt % naphthenes, e.g., at most about 75 wt % naphthenes, at most about 70 wt % naphthenes, at most about 65 wt % naphthenes, at most about 60 wt % naphthenes, at most about 55 wt % naphthenes, at most about 50 wt % naphthenes, at most about 45 wt % naphthenes, at most about 40 wt % naphthenes, at most about 35 wt % naphthenes, at most about 30 wt % naphthenes, or at most about 25 wt % naphthenes. In particular, the liquid hydrocarbon product (e.g., diesel fuel) prior to contact with the activated carbon described herein may comprise at most about 70 wt % naphthenes, at most about 60 wt % naphthenes, or at most about 55 wt % naphthenes.

Additionally or alternatively, the liquid hydrocarbon product (e.g., diesel fuel) prior to contact with the activated carbon described herein may comprise about 25 wt % to about 80 wt % naphthenes, e.g., about 25 wt % to about 75 wt % naphthenes, about 25 wt % to about 70 wt % naphthenes, about 25 wt % to about 65 wt % naphthenes, about 25 wt % to about 60 wt % naphthenes, about 25 wt % to about 55 wt % naphthenes, about 25 wt % to about 50 wt % naphthenes, about 25 wt % to about 45 wt % naphthenes, about 25 wt % to about 40 wt % naphthenes, about 25 wt % to about 35 wt % naphthenes, about 25 wt % to about 30 wt %, naphthenes, about 30 wt % to about 80 wt % naphthenes, about 30 wt % to about 75 wt % naphthenes, about 30 wt % to about 70 wt % naphthenes, about 30 wt % to about 65 wt % naphthenes, about 30 wt % to about 60 wt % naphthenes, about 30 wt % to about 55 wt % naphthenes, about 30 wt % to about 50 wt % naphthenes, about 30 wt % to about 45 wt % naphthenes, about 30 wt % to about 40 wt % naphthenes, about 30 wt % to about 35 wt % naphthenes, about 35 wt % to about 80 wt % naphthenes, about 35 wt % to about 75 wt % naphthenes, about 35 wt % to about 70 wt % naphthenes, about 35 wt % to about 65 wt % naphthenes, about 35 wt % to about 60 wt % naphthenes, about 35 wt % to about 55 wt % naphthenes, about 35 wt % to about 50 wt % naphthenes, about 35 wt % to about 45 wt % naphthenes, about 35 wt % to about 40 wt % naphthenes, about 40 wt % to about 80 wt % naphthenes, about 40 wt % to about 75 wt % naphthenes, about 40 wt % to about 70 wt % naphthenes, about 40 wt % to about 65 wt % naphthenes, about 40 wt % to about 60 wt % naphthenes, about 40 wt % to about 55 wt % naphthenes, about 40 wt % to about 50 wt % naphthenes, about 40 wt % to about 45 wt % naphthenes, about 45 wt % to about 80 wt % naphthenes, about 45 wt % to about 75 wt % naphthenes, about 45 wt % to about 70 wt % naphthenes, about 45 wt % to about 65 wt % naphthenes, about 45 wt % to about 60 wt % naphthenes, about 45 wt % to about 55 wt % naphthenes, about 45 wt % to about 50 wt % naphthenes, about 50 wt % to about 80 wt % naphthenes, about 50 wt % to about 75 wt % naphthenes, about 50 wt % to about 70 wt % naphthenes, about 50 wt % to about 65 wt % naphthenes, about 50 wt % to about 60 wt % naphthenes, about 50 wt % to about 55 wt % naphthenes, about 55 wt % to about 80 wt % naphthenes, about 55 wt % to about 75 wt % naphthenes, about 55 wt % to about 70 wt % naphthenes, about 55 wt % to about 65 wt % naphthenes, about 55 wt % to about 60 wt % naphthenes, about 60 wt % to about 80 wt % naphthenes, about 60 wt % to about 75 wt % naphthenes, about 60 wt % to about 70 wt % naphthenes, about 60 wt % to about 65 wt % naphthenes, about 65 wt % to about 80 wt % naphthenes, about 65 wt % to about 75 wt % naphthenes, about 65 wt % to about 70 wt % naphthenes, about 70 wt % to about 80 wt % naphthenes, about 70 wt % to about 75 wt % naphthenes, or about 75 wt % to about 80 wt % naphthenes. In particular, the liquid hydrocarbon product (e.g., diesel fuel) prior to contact with the activated carbon described herein may comprise about 25 wt % to about 80 wt % naphthenes, about 25 wt % to about 70 wt % naphthenes, or about 30 wt % to about 60 wt % naphthenes.

Additionally or alternatively, the liquid hydrocarbon product (e.g., diesel fuel) prior to contact with the activated carbon described herein may comprise at most about 65 wt % aromatics, e.g., at most about 60 wt % aromatics, at most about 55 wt % aromatics, at most about 50 wt % aromatics, at most about 45 wt % aromatics, at most about 40 wt % aromatics, at most about 35 wt % aromatics, at most about 30 wt % aromatics, at most about 25 wt % aromatics, or at most about 20 wt % aromatics. In particular, the liquid hydrocarbon product (e.g., diesel fuel) prior to contact with the activated carbon described herein may comprise at most about 60 wt % aromatics, at most about 55 wt % aromatics, or at most about 50 wt % aromatics.

Additionally or alternatively, the liquid hydrocarbon product (e.g., diesel fuel) prior to contact with the activated carbon described herein may comprise about 20 wt % to about 65 wt % aromatics, e.g., about 20 wt % to about 60 wt % aromatics, about 20 wt % to about 55 wt % aromatics, about 20 wt % to about 50 wt % aromatics, about 20 wt % to about 45 wt % aromatics, about 20 wt % to about 40 wt % aromatics, about 20 wt % to about 35 wt % aromatics, about 20 wt % to about 30 wt % aromatics, about 25 wt % to about 65 wt % aromatics, about 25 wt % to about 60 wt % aromatics, about 25 wt % to about 55 wt % aromatics, about 25 wt % to about 50 wt % aromatics, about 25 wt % to about 45 wt % aromatics, about 25 wt % to about 40 wt % aromatics, about 25 wt % to about 35 wt % aromatics, about 25 wt % to about 30 wt %, aromatics, about 30 wt % to about 65 wt % aromatics, about 30 wt % to about 60 wt % aromatics, about 30 wt % to about 55 wt % aromatics, about 30 wt % to about 50 wt % aromatics, about 30 wt % to about 45 wt % aromatics, about 30 wt % to about 40 wt % aromatics, about 30 wt % to about 35 wt % aromatics, about 35 wt % to about 65 wt % aromatics, about 35 wt % to about 60 wt % aromatics, about 35 wt % to about 55 wt % aromatics, about 35 wt % to about 50 wt % aromatics, about 35 wt % to about 45 wt % aromatics, about 35 wt % to about 40 wt % aromatics, about 40 wt % to about 65 wt % aromatics, about 40 wt % to about 60 wt % aromatics, about 40 wt % to about 55 wt % aromatics, about 40 wt % to about 50 wt % aromatics, about 40 wt % to about 45 wt % aromatics, about 45 wt % to about 65 wt % aromatics, about 45 wt % to about 60 wt % aromatics, about 45 wt % to about 55 wt % aromatics, about 45 wt % to about 50 wt % aromatics, about 50 wt % to about 65 wt % aromatics, about 50 wt % to about 60 wt % aromatics, about 50 wt % to about 55 wt % aromatics, about 55 wt % to about 65 wt % aromatics, about 55 wt % to about 60 wt % aromatics, or about 60 wt % to about 65 wt % aromatics. In particular, the liquid hydrocarbon product (e.g., diesel fuel) prior to contact with the activated carbon described herein may comprise about 20 wt % to about 65 wt % aromatics, about 30 wt % to about 55 wt % aromatics, or about 30 wt % to about 50 wt % aromatics.

In one embodiment, the liquid hydrocarbon product (e.g., diesel fuel) prior to contact with the activated carbon described herein may comprise at least one of the following properties:

(i) about 0.5 ppm to about 15 ppm sulfur or about 0.5 ppm to about 10 ppm sulfur;
(ii) about 0.05 ppm to about 10 ppm nitrogen or about 0.05 ppm to about 5.0 ppm nitrogen;
(iii) about 1.0 wt % to about 15 wt % non-cyclic paraffins or about 1.0 wt % to about 10 wt % non-cyclic paraffins;
(iv) about 25 wt % to about 70 wt % naphthenes or about 30 wt % to about 60 wt % naphthenes; and
(v) about 30 wt % to about 55 wt % aromatics or about 30 wt % to about 50 wt % aromatics.

Additionally or alternatively, the liquid hydrocarbon product (e.g., diesel fuel) prior to contact with the activated carbon described herein may comprise at least two of properties (i)-(v). For example, the liquid hydrocarbon product (e.g., diesel fuel) prior to contact with the activated carbon described may comprise: (i) and (ii); (i) and (iii); (i) and (iv); (i) and (v); (ii) and (iii); (ii) and (iv); (ii) and (v); (iii) and (iv); (iii) and (v); or (iv) and (v).

Additionally or alternatively, the liquid hydrocarbon product (e.g., diesel fuel) prior to contact with the activated carbon described herein may comprise at least three of properties (i)-(v). For example, the liquid hydrocarbon product (e.g., diesel fuel) prior to contact with the activated carbon described may comprise: (i), (ii) and (iii); (i), (ii) and (iv); (i) (ii) and (v); (i), (iii) and (iv); (i), (iii) and (v); (i), (iv) and (v); (ii), (iii) and (iv); (ii), (iii) and (v); (ii), (iv) and (v); or (iii), (iv) and (v).

Additionally or alternatively, the liquid hydrocarbon product (e.g., diesel fuel) prior to contact with the activated carbon described herein may comprise at least four of properties (i)-(v). For example, the liquid hydrocarbon product (e.g., diesel fuel) prior to contact with the activated carbon described may comprise: (i), (ii), (iii) and (iv); (i), (ii), (iii) and (v); (i), (iii), (iv), and (v); or (ii), (iii), (iv) and (v).

Additionally or alternatively, the liquid hydrocarbon product (e.g., diesel fuel) prior to contact with the activated carbon described herein may comprise all of (i)-(v).

In various aspects, single ring aromatics, double ring aromatics, or multi-ring aromatics, separately or together (i.e., "total aromatics"), may be removed from a liquid hydrocarbon product (e.g., diesel fuel) in a combined amount of at least about 1.0%, e.g., at least about 2.0%, at least about 4.0%, at least about 6.0%, at least about 8.0%, at least about 10%, at least about 12%, at least about 15%, at least about 20%, at least about 30%, at least about 40%, or at least about 50%. In particular, multi-ring aromatics may be removed from a liquid hydrocarbon product (e.g., diesel fuel) in an amount of at least about 20%, at least about 30%, or at least about 40%. In particular, double-ring aromatics may be removed from a liquid hydrocarbon product (e.g., diesel fuel) in an amount of at least about 7.0% or at least about 10%. In particular, double-ring and multi-ring aromatics may be removed from a liquid hydrocarbon product (e.g., diesel fuel) in a combined amount of at least about 6.0%, at least about 8.0%, at least about 10%, at least about 12%, at least about 15%, or at least about 20%. In particular, total aromatics may be removed from a liquid hydrocarbon product (e.g., diesel fuel) in an amount of at least about 2.0%, at least about 4.0%, or at least about 8.0%.

Additionally or alternatively, single ring aromatics, double ring aromatics, and multi-ring aromatics, separately/individually or together in combinations of two of the three or all three of three, may be removed from a liquid hydrocarbon product (e.g., diesel fuel) in an amount of at most about 60%, e.g., at most about 50%, at most about 40%, at most about 30%, at most about 20%, at most about 15%, at most about 12%, at most about 10%, at most about 8.0%, at most about 6.0%, at most about 4.0%, or at most about 2.0%.

Additionally or alternatively, single ring aromatics, single ring aromatics, double ring aromatics, and multi-ring aromatics, separately/individually or together in combinations of two of the three or all three of three, may be removed from a liquid hydrocarbon product (e.g., diesel fuel) in an amount of about 1.0% to about 60%, e.g., about 1.0% to about 50%, about 1.0% to about 40%, about 1.0% to about 30%, about 1.0% to about 20%, about 1.0% to about 15%, about 1.0% to about 12%, about 1.0% to about 10%, about 1.0% to about 8.0%, about 1.0% to about 6.0%, about 1.0% to about 4.0%, about 1.0% to about 2.0%, about 2.0% to about 60%, about 2.0% to about 50%, about 2.0% to about 40%, about 2.0% to about 30%, about 2.0% to about 20%, about 2.0% to about 15%, about 2.0% to about 12%, about 2.0% to about 10%, about 2.0% to about 8.0%, about 2.0% to about 6.0%, about 2.0% to about 4.0%, about 4.0% to about 60%, about 4.0% to about 50%, about 4.0% to about 40%, about 4.0% to about 30%, about 4.0% to about 20%, about 4.0% to about 15%, about 4.0% to about 12%, about 4.0% to about 10%, about 4.0% to about 8.0%, about 4.0% to about 6.0%, about 6.0% to about 60%, about 6.0% to about 50%, about 6.0% to about 40%, about 6.0% to about 30%, about 6.0% to about 20%, about 6.0% to about 15%, about 6.0% to about 12%, about 6.0% to about 10%, about 6.0% to about 8.0%, about 8.0% to about 60%, about 8.0% to about 50%, about 8.0% to about 40%, about 8.0% to about 30%, about 8.0% to about 20%, about 8.0% to about 15%, about 8.0% to about 12%, about 8.0% to about 10%, about 10% to about 60%, about 10% to about 50%, about 10% to about 40%, about 10% to about 30%, about 10% to about 20%, about 10% to about 15%, about 10% to about 12%, about 12% to about 60%, about 12% to about 50%, about 12% to about 40%, about 12% to about 30%, about 12% to about 20%, about 12% to about 15%, about 15% to about 60%, about 15% to about 50%, about 15% to about 40%, about 15% to about 30%, about 15% to about 20%, about 20% to about 60%, about 20% to about 50%, about 20% to about 40%, about 20% to about 30%, about 30% to about 60%, about 30% to about 50%, about 30% to about 40%, about 40% to about 60%, about 40% to about 50%, or about 50% to about 60%. In particular, multi-ring aromatics may be removed from a liquid hydrocarbon product (e.g., diesel fuel) in an amount of about 10% to about 60%, about 20% to about 50%, or about 30% to about 50%. In particular, double-ring aromatics may be removed from a liquid hydrocarbon product (e.g., diesel fuel) in an amount of about 1.0% to about 20%, about 4.0% to about 15%, or about 6.0% to about 15%. In particular, double-ring and multi-ring aromatics may be removed from a liquid hydrocarbon product (e.g., diesel fuel) in a collective amount of about 1.0% to about 30%, about 1.0% to about 20%, about 4.0% to about 20%, about 8.0% to about 20%, about 10% to about 20%, or about 12% to about 20%. In particular, total aromatics may be removed from a liquid hydrocarbon product (e.g., diesel fuel) in a collective amount of about 1.0% to about 15%, about 1.0% to about 8.0%, about 1.0% to about 6.0%, or about 2.0% to about 6.0%.

In various aspects, a liquid hydrocarbon product (e.g., diesel fuel) may be contacted with the activated carbon described herein in a weight ratio of liquid hydrocarbon product (e.g., diesel fuel) to activated carbon of at least about 1:1, e.g., at least about 5:1, at least about 10:1, at least about 20:1, at least about 50:1, or at least about 75:1. In particular, a liquid hydrocarbon product (e.g., diesel fuel) may be contacted with the activated carbon in a weight ratio of liquid hydrocarbon product (e.g., diesel fuel) to activated carbon of at least about 10:1. Additionally or alternatively, a liquid hydrocarbon product (e.g., diesel fuel) may be contacted with the activated carbon described herein in a weight ratio of liquid hydrocarbon product (e.g., diesel fuel) to activated carbon of at most about 100:1, e.g., at most about 75:1, at most about 50:1, at most about 20:1, at most about 10:1, or at most about 5:1. In particular, a liquid hydrocarbon product (e.g., diesel fuel) may be contacted with the activated carbon in a weight ratio of liquid hydrocarbon product (e.g., diesel fuel) to activated carbon of at most about 100:1 or at most about 75:1.

In various aspects, a liquid hydrocarbon product (e.g., diesel fuel) may be contacted with the activated carbon described herein at a temperature of at least about 10° C., e.g., at least about 12° C., at least about 14° C., at least about 16° C., at least about 18° C., at least about 20° C., at least about 22° C., at least about 24° C., at least about 26° C., at least about 28° C., at least about 30° C., at least about 32° C., at least about 34° C., at least about 36° C., at least about 38° C., at least about 40° C., at least about 45° C., at least about 50° C., at least about 55° C., at least about 60° C., at least about 65° C., at least about 70° C., or at least about 75° C. In particular, a liquid hydrocarbon product (e.g., diesel fuel) may be contacted with the activated carbon described herein at a temperature about 10° C. to about 80° C., about 12° C. to about 40° C., about 14° C. to about 36° C., or about 18° C. to about 28° C.

Additionally or alternatively, a liquid hydrocarbon product (e.g., diesel fuel) may be contacted with the activated carbon, optionally in combination with the temperatures described above, at a pressure of at least about 2.0 psig (~13 kPag), e.g., at least about 4.0 psig (~27 kPag), at least about 5.0 psig (~35 kPag), at least about 6.0 psig (~41 kPag), at least about 8.0 psig (~55 kPag), at least about 10 psig (~69 kPag), at least about 12 psig (~82 kPag), at least about 14 psig (~96 kPag), at least about 15 psig (~100 kPag), at least about 16 psig (~110 kPag), at least about 18 psig (~120 kPag), at least about 20 psig (~140 kPag), at least about 25 psig (~170 kPag), or at least about 30 psig (~210 kPag). In particular, a liquid hydrocarbon product (e.g., diesel fuel) may be contacted with the activated carbon, optionally, in combination with the temperatures described above, at a pressure of about 2.0 psig (~13 kPag) to about 30 psig (~210 kPag), about 4.0 psig (~27 kPag) to about 25 psig (~170 kPag), about 5.0 psig (~35 kPag) to about 16 psig (~110 kPag), about 6.0 psig (~41 kPag) to about 15 psig (~100 kPag), or about 10 psig (~69 kPag) to about 15 psig ~(100 kPag). Advantageously, the liquid hydrocarbon product (e.g., diesel fuel) may be contacted with the activated carbon under relatively low severity conditions and even ambient conditions (e.g., temperature of about 20° C. to about 28° C. and pressure of about 10 psig (~69 kPag) to about 15 psig (~100 kPag)), such that the process can require less energy and be lower in cost.

In various aspects, the activated carbon may be in powder form, granular form, and/or extruded form. Additionally or alternatively, the activated carbon may be packed into a column and the liquid hydrocarbon product (e.g., diesel fuel) may be contacted therein, wherein the impurities described herein may be adsorbed onto/into the activated carbon. Additionally or alternatively, the liquid hydrocarbon product (e.g., diesel fuel) may be contacted with activated carbon following hydrotreatment of the liquid hydrocarbon product (e.g., diesel fuel). Incorporation of such an adsorption step after hydrotreatment can beneficially allow for longer hydrotreating cycle lengths and/or decreased catalyst regeneration frequency thereby lowering overall hydrotreating costs.

III. Further Embodiments

The invention can additionally or alternatively include one or more of the following embodiments.

Embodiment 1

A method for reducing impurities (e.g., polar compounds, such as nitrogen-containing compound and/or sulfur-containing compounds, and/or aromatic compounds, such as single ring aromatics, double ring aromatics, and/or multi-ring aromatics) in a liquid hydrocarbon product (e.g., diesel fuel) comprising contacting the liquid hydrocarbon product (e.g., diesel fuel) with activated carbon, wherein the liquid hydrocarbon product (e.g., diesel fuel) has a change in color level of greater than 2.7 (e.g., at least about 3.0 or at least about 3.5), wherein the change in color level is measured as a difference between the liquid hydrocarbon product (e.g., diesel fuel) color level prior to contact with the activated carbon and the liquid hydrocarbon product (e.g., diesel fuel) color level after contact with the activated carbon, wherein the color level is measured according to D6045 ASTM, and wherein at least about 10% (e.g., at least about 12%, at least about 15%, or at least about 20%) of the double ring aromatics and multi-ring aromatics are removed from the liquid hydrocarbon product (e.g., diesel fuel).

Embodiment 2

A method for improving color in a diesel fuel product comprising contacting the diesel fuel product with activated carbon and retrieving an improved color diesel fuel product through removal of at least about 10% (e.g., at least about 12%, at least about 15%, or at least about 20%) of the double ring aromatics and multi-ring aromatics from the diesel fuel product, which improved color diesel fuel product has undergone a change in color level of greater than 2.7 (e.g., at least about 3.0 or at least about 3.5), wherein the change in color level is measured as a difference between the diesel fuel product color level prior to contact with the activated carbon and the improved diesel fuel color product level after contact with the activated carbon, and wherein the color level is measured according to D6045 ASTM.

Embodiment 3

The method of embodiment 1 or embodiment 2, wherein at least about 20% or at least about 30% of the multi-ring aromatics are removed from the liquid hydrocarbon product/diesel fuel and/or at least about 10% of the double ring aromatics are removed from the liquid hydrocarbon product/diesel fuel.

Embodiment 4

The method of any one of the previous embodiments, wherein the liquid hydrocarbon product/diesel fuel is contacted with the activated carbon at a temperature of about 18° C. to about 28° C. and/or a pressure of about 5 psig (~35 kPa) to about 15 psig (~110 kPa).

Embodiment 5

The method of any one of the previous embodiments, wherein the liquid hydrocarbon product (e.g., diesel fuel) comprises at most about 10 ppm sulfur.

Embodiment 6

The method of any one of the previous embodiments, wherein the liquid hydrocarbon product/diesel fuel prior to contact with the activated carbon comprises one or more (e.g., at least two, at least three, at least four, five) of the following:

(i) about 0.5 ppm to about 10 ppm sulfur;

(ii) about 0.05 ppm to about 10 ppm nitrogen;

(iii) about 1.0 wt % to about 15 wt % non-cyclic paraffins;
(iv) about 25 wt % to about 70 wt % naphthenes; and
(v) about 30 wt % to about 55 wt % aromatics.

Embodiment 7

The method of any one of the previous embodiments, wherein the liquid hydrocarbon product/diesel fuel has a color level of greater than about 3.0, in particular at least about 4.0, at least about 4.5, or at least about 5.0, as measured according to D6045 ASTM prior to contact with the activated carbon.

Embodiment 8

The method of any one of the previous embodiments, wherein the liquid hydrocarbon product/diesel fuel has a color level of at most about 3.0 or at most about 2.0 as measured according to D6045 ASTM following contact with the activated carbon.

Embodiment 9

The method of any one of the previous embodiments, wherein the activated carbon has a surface area of at least about 1000 $m^2/g$.

Embodiment 10

The method of any one of the previous embodiments, wherein the activated carbon is packed into a column.

Embodiment 11

The method of any one of the previous embodiments, wherein the liquid hydrocarbon product/diesel fuel is contacted with the activated carbon following hydrotreatment of the liquid hydrocarbon product/diesel fuel.

EXAMPLES

Example 1—Batch Adsorption Experiment on Discolored Diesel Product

Experiments were done on a Perkin Elmer Lambda 850™ UV-Vis spectrophotometer with Scantrag™ software by FTG. Samples were analyzed at room temp (~15-25° C.) in a ~1 mm flow cell. If necessary, samples may be combined with cyclohexane in solution.

Activated carbon samples (Norit® RX-3 and Sorbonorit® 4 obtained from Cabot Corporation) and an air calcined MCM-41 sample were tested in batch adsorption experiments according to ASTM D6045 on a discolored diesel product ("neat feed") which was generated by high-temperature hydrotreating of an on-spec diesel product. MCM-41 may be synthesized according to the description provide in Kresge, C. T., Leonowicz, M. E., Roth, W. J., Vartuli, J. C., and Beck, J. S. *Nature,* 1992. 359: 710-712; Beck, J. S., Vartuli, J. C., Roth, W. J., Leonowicz, M. E., Kresge, C. T., Schmitt, K. D., Chu, C. T. D., Olson, D. H., Sheppard, E. W., McCullen, S. B., Higgins, J. B., and Schlenker, J. L. *J. Am. Chem. Soc.,* 1992. 114: 10834-10843; and/or U.S. Pat. No. 5,057,296.

Nitrogen adsorption/desorption analyses was performed with different instruments, e.g. TriStar™ 3000, TriStar II™ 3020 and Autosorb™-1 on the samples and the results are shown in Table 1 below. All the samples were pre-treated at ~120° C. in vacuum for ~4 hours before collecting the $N_2$ isotherm. The analysis program calculated the experimental data and reported BET surface area, microporous surface area, total pore volume, micropore volume, pore size distribution adsorption, etc.

TABLE 1

| | Air Calcined MCM-41 | Norit ® RX-3 | Sorbonorit ® 4 |
|---|---|---|---|
| BET total Surface Area ($m^2/gm$) | 1120 | ~1220 | ~1470 |
| Micropore Surface Area ($m^2/gm$) | | ~1170 | ~1370 |
| Micropore volume (cc/gm) | | ~0.48 | ~0.59 |
| Pore Volume (cc/gm) | ~1.02 | ~0.55 | ~0.74 |
| Pore Size Distribution Adsorption (nm) | ~3.2 | ~3.9 | ~4.6 |

The properties of the neat feed are shown below in Table 2.

TABLE 2

| Property | High-temperature Hydrotreated Diesel Product (Neat Feed) |
|---|---|
| Saybolt Color (D6045) | L5.0 |
| Sulfur (ppm) | ~2.6 |
| Total Nitrogen (ppm) | ~0.2 |
| PARAFFINS (wt %) | ~5.61 |
| 1-RING NAPHTHENES (wt %) | ~12.2 |
| 2+ RING NAPHTHENES (wt %) | ~38.2 |
| 1 RING AROMATICS (wt %) | ~29.9 |
| 2 RING AROMATICS (wt %) | ~8.4 |
| 3+ RINGS AROMATICS (wt %) | ~5.7 |
| TOTAL NAPHTHENES (wt %) | ~50.4 |
| TOTAL AROMATICS (wt %) | ~44.0 |

UV-Vis Method

Figures 2A, 2B, 2C, 2D:
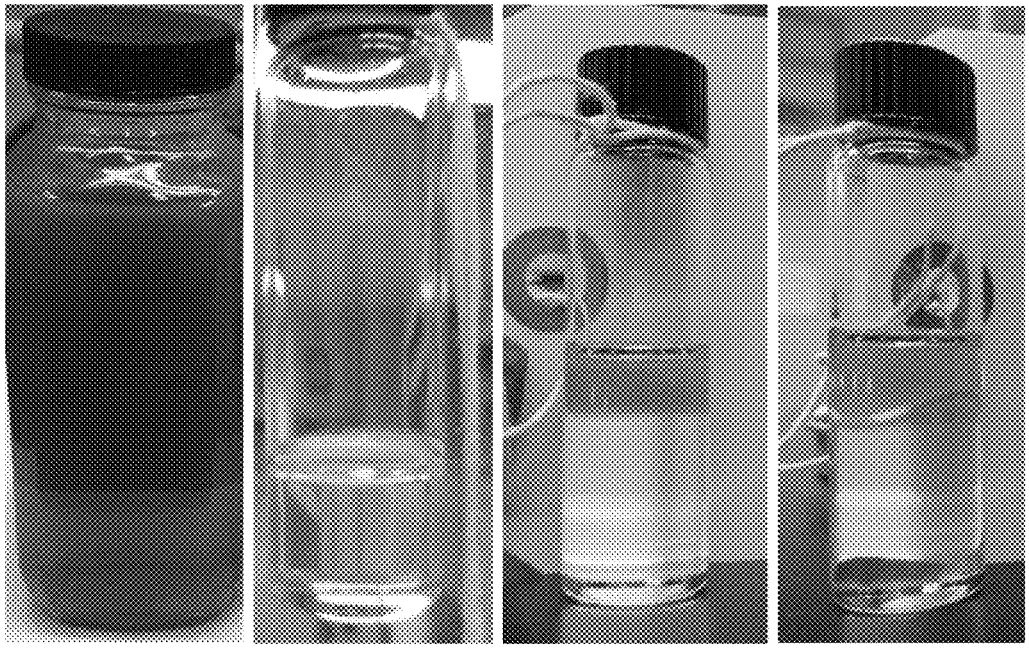
FIGS. 2*a*-2*d* illustrate color improvement of a neat diesel feed, neat diesel feed treated with MCM-41, neat diesel feed treated with Norit® RX-3 and neat diesel feed treated with Sorbonorit®-4, respectively.

The reduction of multi-ring aromatic compounds in the diesel feed treated with Norit® RX-3, Sorbonorit® 4, and air calcined MCM-41 based on UV-Vis adsorption is shown below in Table 3. Aromatic content in a diesel sample can be determined by any convenient method. ASTM D2008 provides one example of a method of correlating UV-Vis data with a weight of aromatics in a sample. UV absorbance at ~226 nm has previously been used to characterize the total aromatics content in a product (see U.S. Pat. No. 6,569,312, which is incorporated by reference herein, for this purpose). UV absorbance at ~325 nm is believed to indicate multi-ring aromatic content. The ratio of absorptivity at ~325 nm to absorptivity at ~226 nm can show the selectivity of multi-ring aromatic removal. UV-Vis adsorption spectra for the feed and Norit® RX-3, Sorbonorit® 4, and air calcined MCM-41 are shown in FIG. 1. As shown in FIG. 1, color improvement in the diesel feed can be evidenced by the reduction of visible range absorption peak intensity at ~400-600 nm wavelengths. Additionally, FIG. 2 provides a photograph of the feed before and after adsorption. As shown in FIG. 2, color improvement was observed for the diesel feed treated with Norit® RX-3 (lighter color) and Sorbonorit® 4 (lighter color) versus untreated, neat diesel feed (darker color). Furthermore, a greater color improvement was observed for the diesel feed treated with Norit® RX-3 and Sorbonorit® 4 versus the diesel fuel treated with MCM-41.

TABLE 3

| | Polars | |
|---|---|---|
| | Value | % Reduction |
| Feed | ~336 | — |
| Air Calcined MCM-41 | ~317 | ~5.5 |
| Norit ® RX-3 | ~323 | ~3.8 |
| Sorbonorit ® 4 | ~327 | ~2.6 |

High-Definition Hydrocarbon Analysis, Color Testing and Gravity Testing

A detailed comparison of the feed in Table 2 and product properties after the feed was treated with Norit® RX-3 and Sorbonorit® 4 was performed using High-Definition Hydrocarbon Analysis—SFC (supercritical fluid chromatograph), color testing according ASTM D6045, and gravity testing according to a modified test method ASTM D4052. A commercial SFC system was employed for analysis of distillates. The system was equipped with the following components:

A. a high pressure pump for delivery of supercritical carbon dioxide mobile phase;

B. temperature controlled column oven;

C. auto-sampler with high pressure liquid injection valve for delivery of sample material into mobile phase;

D. flame ionization detector;

E. mobile phase splitter (low dead volume tee);

F. back pressure regulator to keep the $CO_2$ in supercritical state; and

G. a computer and data system for control of components and recording of data signal.

For analysis, samples were loaded neat into ~2 ml standard septum cap autosampler vials. The sample was introduced via the high pressure sampling valve. The SFC separation was performed using multiple commercial silica packed columns (~5 micron ~30 angstrom pores) connected in series (~250 mm in length by ~4 mm ID). Column temperature was held typically at ~35° C. or ~40° C. For analysis, the head pressure of the columns was typically ~250 bar. Liquid $CO_2$ flow rates were ~2.0 ml/minute for ~4 mm ID columns. The SFC FID signal was integrated into molecular class regions based on elution time. Integrated areas were used to determine the weight % of molecular classes.

The D4052 method was modified with following points:

A. Deionized (DI) water was not boiled prior to calibrating the instruments;

B. Calibration was performed only at ~25° C., regardless of testing temperature (Section 3.2.1 of D4052 does allow for this modification);

C. Measurements were not run in duplicates (D4052 does allow for this modification); and D. Precision limits were based on lube basestocks and single determinations.

The results are shown below in Table 4.

TABLE 4

| Properties | Feed | Sorbonorit-4 | Norit RX-3 |
|---|---|---|---|
| Color | L5.0 | | L1.0 |
| PARAFFINS (wt %) | ~5.6 | ~5.5 | ~8.0 |
| 1-RING NAPHTHENES (wt %) | ~12.2 | ~11.5 | ~13.8 |
| 2+ RING NAPHTHENES (wt %) | ~38.2 | ~39.9 | ~39.5 |
| 1 RING AROMATICS (wt %) | ~29.9 | ~31.3 | ~27.8 |
| 2 RING AROMATICS (wt %) | ~8.4 | ~8.6 | ~7.9 |
| 3+ RINGS AROMATICS (wt %) | ~5.7 | ~3.2 | ~3.2 |

TABLE 4-continued

| Properties | Feed | Sorbonorit-4 | Norit RX-3 |
|---|---|---|---|
| TOTAL NAPHTHENES (wt %) | ~50.4 | ~51.4 | ~53.2 |
| TOTAL AROMATICS (wt %) | ~44.0 | ~43.1 | ~38.8 |
| API Gravity | ~26.4 | ~27.1 | ~27.0 |
| Density (gm/cc) | ~0.895 | ~0.891 | ~0.892 |

Distillation Curve Analysis

Simulated distillation curves were produced for the neat feed, feed treated with Norit® RX-3 and feed treated with Sorbonorit® 4. The simulated distillation curves were produced using enhanced ASTM method D2887. The D2887 was enhanced by adding additional calibration points for C2, C3, and C4 components. The results are shown in Table 5 below and the distillation curves in FIG. 3.

TABLE 5

| % Off | Neat Feed | Sorbonorit-4 Product | Norit RX-3 Product |
|---|---|---|---|
| 0.5 | ~291 | ~291 | ~291 |
| 5 | ~375 | ~380 | ~381 |
| 10 | ~402 | ~407 | ~407 |
| 20 | ~436 | ~440 | ~440 |
| 30 | ~460 | ~463 | ~463 |
| 40 | ~484 | ~486 | ~487 |
| 50 | ~505 | ~506 | ~506 |
| 60 | ~529 | ~529 | ~529 |
| 70 | ~556 | ~554 | ~554 |
| 80 | ~584 | ~582 | ~583 |
| 90 | ~623 | ~620 | ~620 |
| 95 | ~652 | ~650 | ~650 |
| 99 | ~711 | ~701 | ~704 |
| 99.5 | ~740 | ~725 | ~731 |

Figure 3:
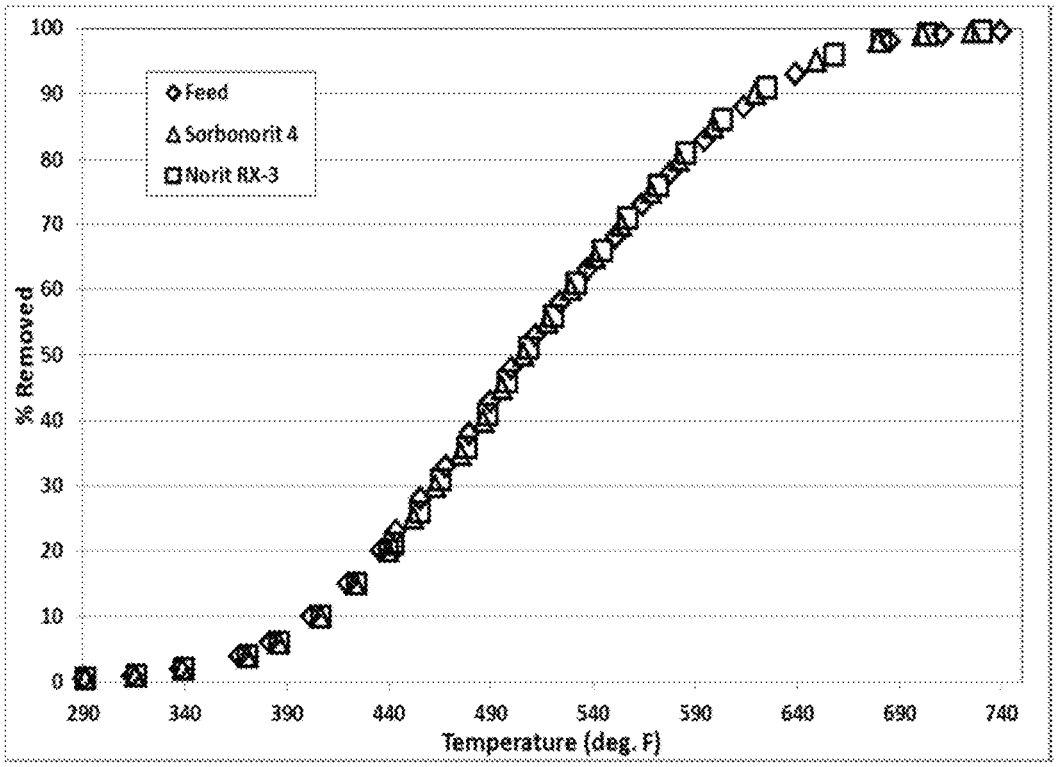
FIG. 3 illustrates a distillation curve comparing neat diesel feed, diesel feed treated with Norit® RX-3, and diesel feed treated with Sorbonorit®-4.

As shown in the FIG. 3, the feed treated with Norit® RX-3 and the feed treated with Sorbonorit® 4 appeared to have similar distillation curves as the untreated, neat feed.

The invention claimed is:

1. A method for reducing impurities in a diesel fuel comprising contacting the diesel fuel with activated carbon, wherein the diesel fuel has a change in color level of greater than 2.7, wherein the change in color level is measured as a difference between the diesel fuel color level prior to contact with the activated carbon and the diesel fuel color level after contact with the activated carbon, and wherein the color level is measured according to D6045 ASTM, wherein the impurities comprise double ring aromatics and multi-ring aromatics, and at least about 15% of the double ring aromatics and multi-ring aromatics are removed from the diesel fuel.

2. The method of claim 1, wherein the diesel fuel has a change in color level of at least about 3.5.

3. The method of claim 1, wherein the impurities further comprise single ring aromatics and polar compounds selected from the group consisting of nitrogen-containing compounds, sulfur-containing compounds and a combination thereof.

4. The method of claim 1, wherein at least about 20% of the multi-ring aromatics are removed from the diesel fuel.

5. The method of claim 1, wherein at least about 30% of the multi-ring aromatics are removed from the diesel fuel.

6. The method of claim 1, wherein at least about 10% of the double ring aromatics are removed from the diesel fuel.

7. The method of claim 1, wherein the diesel fuel is contacted with the activated carbon at a temperature of about 18° C. to about 28° C. and/or a pressure of about 5 psig (about 35 kPa) to about 16 psig (about 110 kPa).

8. The method of claim 1, wherein the diesel fuel prior to contact with the activated carbon comprises at most about 10 ppm sulfur.

9. The method of claim 1, wherein the diesel fuel prior to contact with the activated carbon comprises one or more of the following:

(i) about 0.5 ppm to about 10 ppm sulfur;

(ii) about 0.05 ppm to about 10 ppm nitrogen;

(iii) about 1.0 wt % to about 15 wt % non-cyclic paraffins;

(iv) about 25 wt % to about 70 wt % naphthenes; and (v) about 30 wt % to about 55 wt % aromatics.

10. The method of claim 9, wherein the diesel fuel prior to contact with the activated carbon comprises (i)-(v).

11. The method of claim 1, wherein the diesel fuel has a color level of greater than about 3.0 as measured according to D6045 ASTM prior to contact with the activated carbon.

12. The method of claim 1, wherein the diesel fuel has a color level of at least about 4.5 as measured according to D6045 ASTM prior to contact with the activated carbon.

13. The method of claim 1, wherein the diesel fuel has a color level of at most about 3.0 as measured according to D6045 ASTM following contact with the activated carbon.

14. The method of claim 1, wherein the diesel fuel has a color level of at most about 2.0 as measured according to D6045 ASTM following contact with the activated carbon.

15. The method of claim 1, wherein the activated carbon has a surface area of at least about 1000 $m^2/g$.

16. The method of claim 1, wherein the activated carbon is packed into a column and the diesel fuel is contacted therein.

17. The method of claim 1, wherein the diesel fuel is contacted with the activated carbon following hydrotreatment of the diesel fuel.

18. A method for improving color in a diesel fuel product comprising contacting the diesel fuel product comprising double ring aromatics and multi-ring aromatics with activated carbon; and retrieving an improved color diesel fuel product through removal of at least about 15% of the double ring aromatics and multi-ring aromatics from the diesel fuel product, which improved color diesel fuel product has undergone a change in color level of greater than 2.7, wherein the change in color level is measured as a difference between the diesel fuel product color level prior to contact with the activated carbon and the improved diesel fuel color product level after contact with the activated carbon, and wherein the color level is measured according to D6045 ASTM.

19. The method of claim 18, wherein the improved color diesel fuel product has undergone a change in color level of at least about 3.0.

20. The method of claim 18, wherein the improved color diesel fuel product has undergone a change in color level of at least about 3.5.

21. The method of claim 18, wherein the diesel fuel product has a color level of greater than about 3.0 as measured according to D6045 ASTM prior to contact with the activated carbon.

22. The method of claim 18, wherein the diesel fuel product has a color level of at least about 5.0 as measured according to D6045 ASTM prior to contact with the activated carbon.

23. The method of claim 18, wherein the improved color diesel fuel product has a color level of at most about 3.0 as measured according to D6045 ASTM.

24. The method of claim 18, wherein the improved color diesel fuel product has a color level of at most about 2.0 as measured according to D6045 ASTM.

25. The method of claim 18, wherein the diesel fuel product is contacted with the activated carbon at a temperature of about 18° C. to about 28° C. and/or a pressure of about 5 psig (about 35 kPag) to about 15 psig (about 110 kPag).

26. The method of claim 18, wherein the diesel fuel product is contacted with the activated carbon following hydrotreatment of the diesel fuel.

27. The method of claim 18, wherein the activated carbon is packed into a column.

* * * * *